United States Patent [19]

Vidalenq

[11] 4,055,152

[45] Oct. 25, 1977

[54] GAS BOILER, PARTICULARLY FOR CENTRAL HEATING

[76] Inventor: Maurice Vidalenq, 27, rue du Marechal Joffre, 78430 Louveciennes, France

[21] Appl. No.: 693,627

[22] Filed: June 7, 1976

[30] Foreign Application Priority Data

June 9, 1975 France ..... 75.17959
Apr. 21, 1976 France ..... 76.11692

[51] Int. Cl.[2] ..... F22B 15/00; F22B 37/10; F23L 17/00

[52] U.S. Cl. ..... 122/235 R; 122/367 C; 431/157

[58] Field of Search ..... 122/235 R, 250 R, 367 R, 122/367 C; 431/157

[56] References Cited

U.S. PATENT DOCUMENTS

| | | | |
|---|---|---|---|
| 3,302,684 | 2/1967 | Banko | 431/157 |
| 3,315,646 | 4/1967 | Witten, Jr. | 122/367 R |
| 3,701,340 | 10/1972 | Miller | 122/367 C |
| 3,765,823 | 10/1973 | Kawabata et al. | 431/157 |
| 3,895,608 | 7/1975 | Sakhuja | 122/250 |

*Primary Examiner*—Kenneth W. Sprague
*Attorney, Agent, or Firm*—Stevens, Davis, Miller & Mosher

[57] ABSTRACT

Gas-burning boilers have in a chamber a plurality of finned heat-exchange tubes arranged around a central gas burner which is substantially of the same length as the finned tubes. An extraction fan draws gases from the chamber such that the chamber works under sub-atmospheric pressure which is preferably 12 mm water column or more below atmospheric.

Baffles provide that hot gases must pass over the heat-exchange tubes as they go from the burner to the fan. A self-operating pressure regulator may be provided for the chamber, and various advantages constructions of burner are disclosed which give silent and evenly distributed burning of the gases. The burner is arranged on a horizontal axis and so as to be withdrawable as a unit from the chamber without affecting the heat-exchanger tubes or baffle arrangements.

19 Claims, 11 Drawing Figures

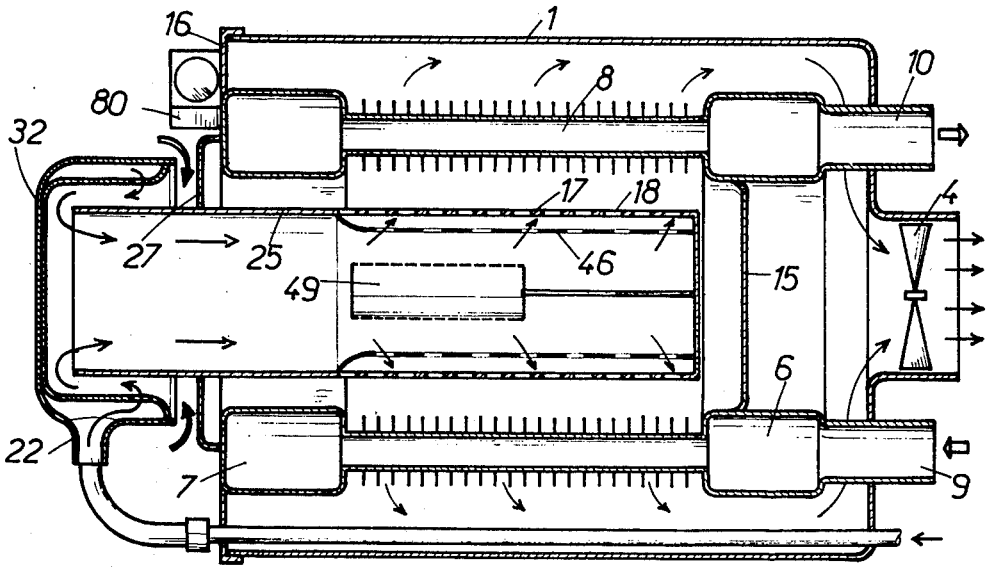
FIG.:3
FIG.:5
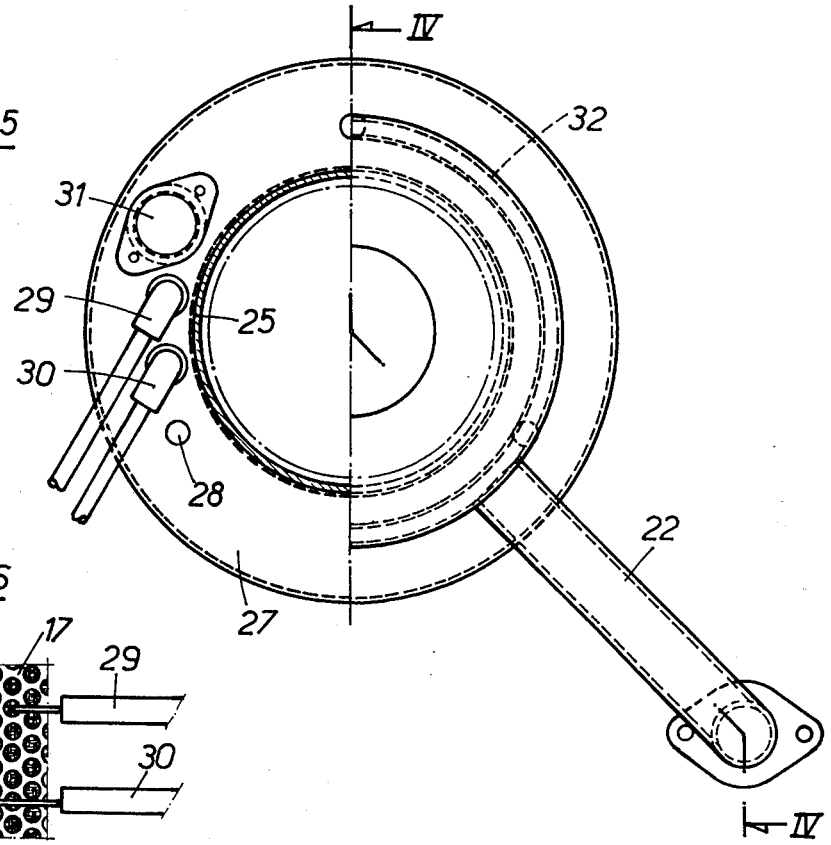
FIG.:6
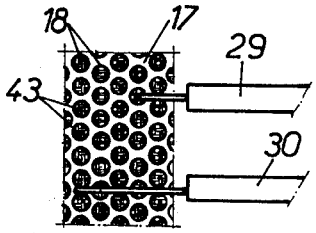

GAS BOILER, PARTICULARLY FOR CENTRAL HEATING

The present invention relates to a gas boiler comprising a vessel which is connected to a combustion gas discharge pipe and into which penetrates a tubular burner surrounded by a cylindrical heat exchanger composed of finned tubes parallel to the burner and mounted between two annular headers, the said exchanger being closed at its end by a transverse partition in such a manner that the combustion gases are obliged to pass between the tubes in order to reach the discharge pipe. The latter is connected to a suction device, for example a centrifugal fan, in such a manner that the hearth of the boiler functions under reduced pressure.

The reduced pressure in the vessel preferably amounts to at least 12 millimeters water column, preferably from 15 to 50 millimeters depending on the power of the boiler, while a reduced pressure regulator is advantageously provided, particularly in order to facilitate ignition from the cold state.

The burner, the perforated portion of which advantageously extends over substantially the entire length of the tubes of the exchanger, facing and at a short distance from these tubes, may be provided internally with a grid which is disposed along the said portion and to which the flame clings, which grid may in addition be lined by a perforated sleeve producing a loss of head which ensures uniformity of distribution of the mixture of air and gas inspired through the holes of the burner.

Outside the boiler the burner is advantageously provided with a cup-shaped distributor which caps its open end and protects the latter while effecting uniform distribution of the gas and while remaining small in size.

In order to avoid the risk of vaporisation, the exchanger tubes are preferably provided with cores occupying about half their passage section and increasing the speed of circulation of the water.

The boiler is advantageously made in the shape of a right parallelpiped, in which the assembly comprising the exchanger and burner is disposed horizontally, while it is possible for a plurality of elementary boilers connected in parallel to be stacked one on the other within a very small space.

The description given below with reference to the accompanying drawings, which are given by way of example without limitation, will make it clear how the invention may be performed; obviously the details revealed both by the drawings and by the text form part of this invention.

FIG. 3 is a diagrammatical longitudinal section of a modified boiler according to the present invention;

FIG. 5 is a corresponding elevation with half-section on the line V—V in FIG. 4;

FIG. 6 is a partial developed view showing the perforations of the burner tube;

Figure 1:
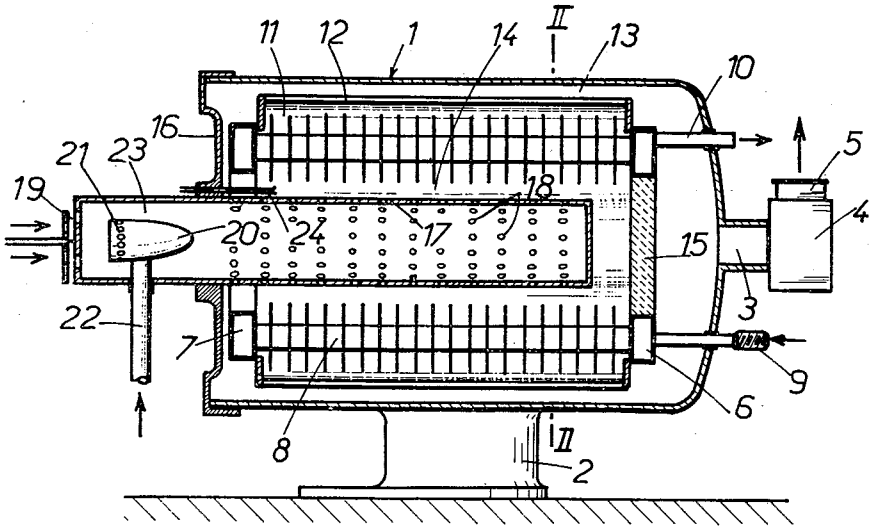
FIG. 1 is a view in median longitudinal section of a boiler according to the invention.

In the example of embodiment illustrated in FIG. 1, the boiler comprises a cylindrical body 1 which rests, for example, horizontally on the ground with the aid of a base 2.

In the end of the cylindrical body 1 is provided a preferably axial connection 3 which leads to a fan 4, for example a centrifugal fan, applying suction to the heating body 1 and delivering through a pipe 5 connected to a chimney or other outlet for the burned gases.

Figure 2:
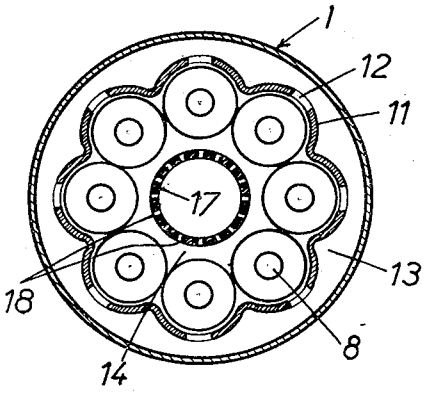
FIG. 2 is a section on the line II—II in FIG. 1.

The heating body 1 contains a heat exchanger composed of two annular headers 6 and 7 disposed coaxially near its ends and connected by longitudinal finned tubes 8, for example of copper, which are brazed on the headers and uniformly distributed between them. The header 6 is provided with an inlet pipe 9 for water or other fluid to be heated and with an outlet pipe 10. These pipes pass through the end of the heating body 1, with seals. The header 6 situated on the fan side has two internal transverse baffles obliging the liquid which is to be heated to circulate through the opposite header 7. Outside the finned tubes 8 are provided baffles 11 (FIG. 2) of V-shaped sections with rounded branches, which baffles are fixed at their ends to the headers and which partly enclose the tubes 8 while leaving facing them longitudinal slots 12 which permit communication between the annular space 13 provided between the baffles and the wall of the heating body, on the one hand, and the space 14 or hearth inside the said baffles. This arrangement permits better circulation of the gases around the fins and better distribution in the hearth of the reduced pressure produced by the fan 4. A partition 15 of refractory product closes off the central aperture of the header 6 situated on the fan side.

The heating body is closed by a cover 16 (FIG. 1), in the axis of which is mounted a tube 17 which serves as burner and is readily detachable.

This tube extends into the hearth to a point close to the partition 15. At its inner end it is closed and is pierced over the whole of its lateral surface inside the hearth with regularly distributed apertures 18 (holes or slots). At its outer end the tube 17 is provided with an air inlet regulating device 19 and it contains a profiled hollow core 20 which is rounded in the downstream direction and in the upstream portion is provided with apertures 21 through which passes out the gas arriving in the core through a lateral pipe 22 passing through the wall of the tube 17.

The core 20 makes it possible to increase the speed in the annular space 23 separating it from the tube 17, in order to improve the mixing of the air and gas. An igniter 24 is associated with the burner 17.

The boiler described above functions in the following manner:

As soon as hot fluid is required from the boiler, the fan 4 is started up. It creates a reduced pressure in the annular space 13 and in the hearth 14. A device (not shown) which is sensitive to this reduced pressure admits gas through the pipe 22, obviously under the usual conditions of safety. The air necessary for combustion is admitted, in the desired stoichiometric proportion, by the regulating device 19. The igniter 24 ignites the mixture passing out of the apertures 18.

The combustion gases bathe the finned tubes 8 and pass into the annular space 13 through the slots 12, and are then taken up by the fan 4 and discharged through the pipe 5.

The invention offers numerous advantages, of which the following may be cited:

The hearth is under reduced pressure, so that any leaks will not entail a loss of combustion products in the boiler-room and there is therefore no risk of accidents being caused. At most, if any leaks should occur, they can easily be compensated by increasing the delivery of the extraction fan 4.

Since the speeds in the combustion product circuit are low, the reduced pressure applied to the holes 18 of the burner is regularly distributed and the flame is very regular over the entire length and over the entire periphery of the burner tube 17.

The burner and exchanger are independent of the unit comprising the gas header and fan. They can easily be inspected or replaced when required. It is simply necessary to pull them out in the forward direction in order to remove them, and then inspect or clean them. Furthermore, they are simple, reliable, and strong.

The most important advantage consists of the extremely small overall dimensions. The volume of the boiler can in fact be estimated to be one-quarter of that of conventional boilers known at the present time, for the same useful power.

The cost price of the boiler is very low because of the extreme simplicity of its construction and of its relative small dimensions.

If designed with a good total opening section, the burner is very quiet compared with the torch type burners generally used (atmospheric or forced circulation).

Moreover, for the purpose of obtaining high power, the small dimensions of the boilers make it very easy to use a battery of a plurality of boilers in parallel, each boiler preferably having its own fan.

FIG. 3 shows once again a boiler of the general type described above, the same references being used to designate parts which have not been substantially modified.

Figure 4:
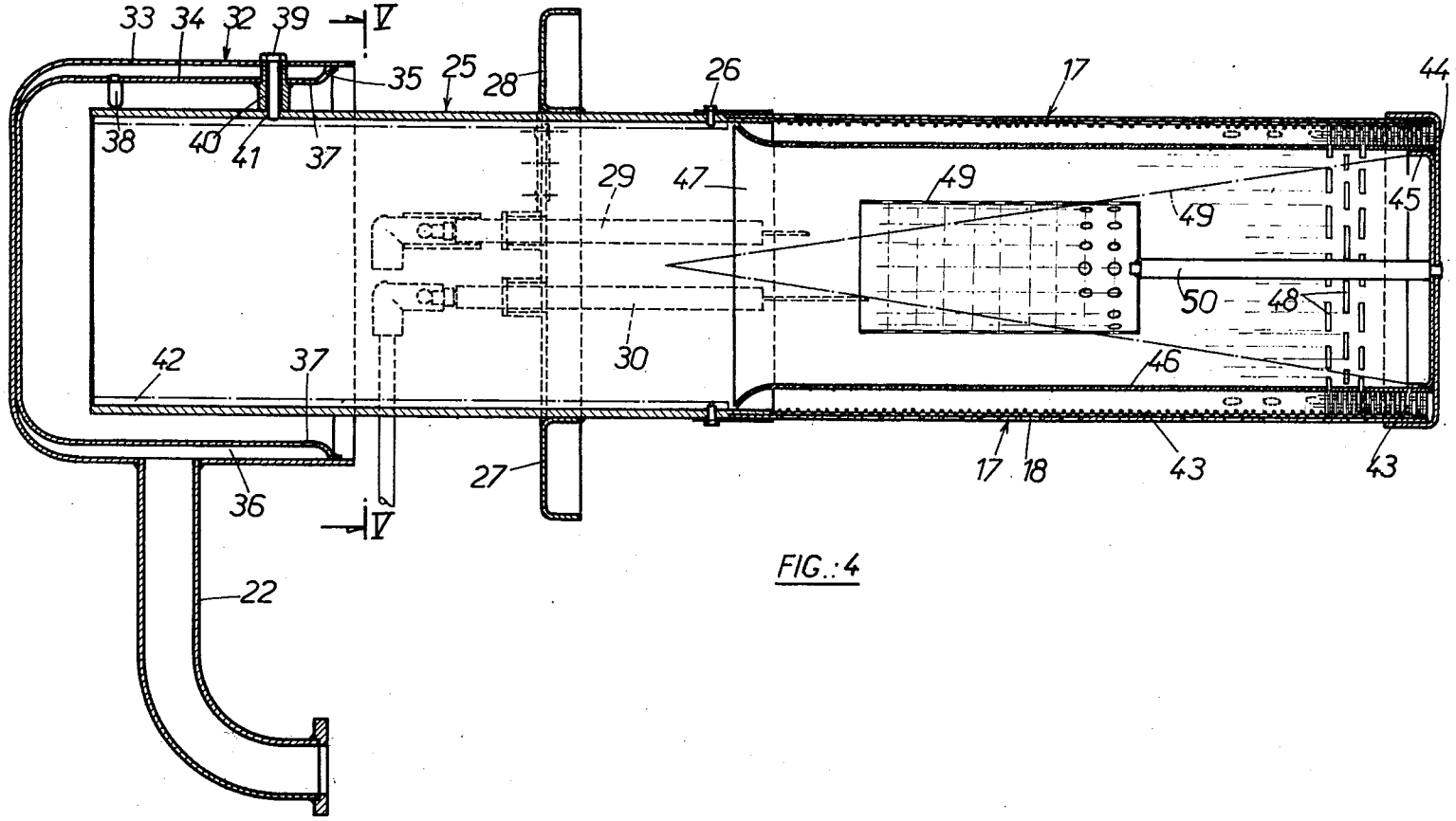
FIG. 4 is a longitudinal section on a larger scale of the burner and its accessories, this section being taken on the line IV—IV in FIG. 5.

As can be seen more clearly in FIGS. 4 and 5, the burner comprises a tubular body 25, on a shouldered end of which is fitted the perforated tube 17, which is fixed with the aid of screws 26. Slightly beyond the screws is welded an outer ring 27 pierced with holes 28 enabling the burner to be mounted on the boiler.

The mounting ring 27 also carries an ignition electrode 29 and an ionisation electrode 30. It is in addition provided with an inspection aperture 31 (FIG. 5).

The end of the tubular body outside the casing 1 of the boiler is capped, with clearance, by an annular gas distributor 32 composed of two cups 33 and 34 nested one in the other. The inner cup has a substantially smaller diameter than the outer cup and its edge 35 is flaired and rounded so as to come into contact with the wall of the outer cup, to which it is welded, thus forming an annular chamber 36. This chamber is connected to the gas source (not shown) by the pipe connection 22. The gas passes out of the annular space formed between the body 25 and the distributor 32 by way of a ring of apertures 37 pierced along the edge 35.

Small internal spacers 38 centre the distributor 32 on the tubular body 25, its fastening being effected by screws 39 which pass through sealing spacer sleeves 40 and finally engage tapped holes 41 in the tubular body. The latter may have an inner refractory lining 42.

The tube 17 is pierced with circular holes 18 in a staggered arrangement, very close to one another, as shown in FIG. 6. The diameter of these holes may be about 8 mm. A lining 43 of wire gauze, providing a clear passage section of about 50%, is disposed inside the tube 17. This lining is intended to hold the combustion flames and to prevent noise when the burner is in operation.

As can be seen in FIG. 6, the end of the ignition electrode 29 stops on the edge of a hole 18, while the ionisation electrode 30 penetrates a few centimeters into the flame zone.

A solid cover 44 closes the end of the tube 17 in the interior of the boiler, the cover 44 having internally a flange 45 on which fits a perforated sleeve 46 lining the entire tube 17 and casing 43 and ending, in the adjacent end of the tubular body, in the form of a rounded edge 47 in contact with the body 25. The sleeve 46 is perforated regularly over its entire surface with slots 48 of a width of about 1 mm and a length of about 10 mm, these slots being directed circumferentially and occupying about 20% of the surface of the sleeve. The sleeve serves to produce a loss of head which effects the equalisation of the pressures in the annular space situated between the sleeve 46 and the lining 43, so as to provide a uniform flow through all the perforations 18 of the tube 17.

This uniformity is improved still further by disposing in the axis of the tube 17 a baffle 49, which may be in the form of a cylindrical cup open at the gas inlet end and closed at the other end, this cup being fixed by means of an axial spacer 50 to the cover 44, or else in the form of a cone whose base fits into the flange 45, as shown in dot-and-dash lines in FIG. 4. The baffle 49 may also be perforated, for example in such a manner as to leave about 30% free passage.

During operation the reduced pressure which prevails in the vessel, and which amounts to about 12 mm water column, preferably from 15 to 50 millimeters water column depending on the power of the boiler, produces in the annular space formed between the tubular body 25 and the distributor 32 a draught of air which entrains the gas passing out of the apertures 37. The mixture of gas and air passes through the openings 48 in the sleeve 46 and leaves by way of the holes 18 in the tube 17; the loss of head due to the presence of the sleeve ensures uniform passage of the mixture through the hose 18, and the flame clings to the wire gauze 43 and burns in silence.

Ignition is effected by the electrode 29 and flame safety is provided by the electrode 30.

Figure 7:
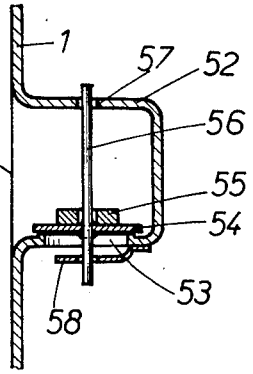
FIG. 7 is a detailed diagrammatical view showing the pressure regulator with which the boiler is equipped.

A device regulating the flow of air for combustion may be dispensed with if the vessel 1 is provided with a reduced pressure regulator, for example of the kind shown in FIG. 7.

The vessel has an opening 51 bringing it into communication with a lateral chamber 52 provided with an opening 53 in its lower face, which is horizontal.

Above this opening is disposed a valve 54 in the form of a plate, which is adapted to close the opening. The valve 54 is weighted by a weight 55 and fixed to a rod 56 guided at the top in a hole 57 in the top wall of the chamber 52 and at the bottom in a hole in a guide lug 58.

This regulator ensures a constant negative pressure in the casing 1. In particular, when starting from cold, it makes it possible to reduce the flow of air in the burner, thus eliminating ignition difficulties.

Figure 8:
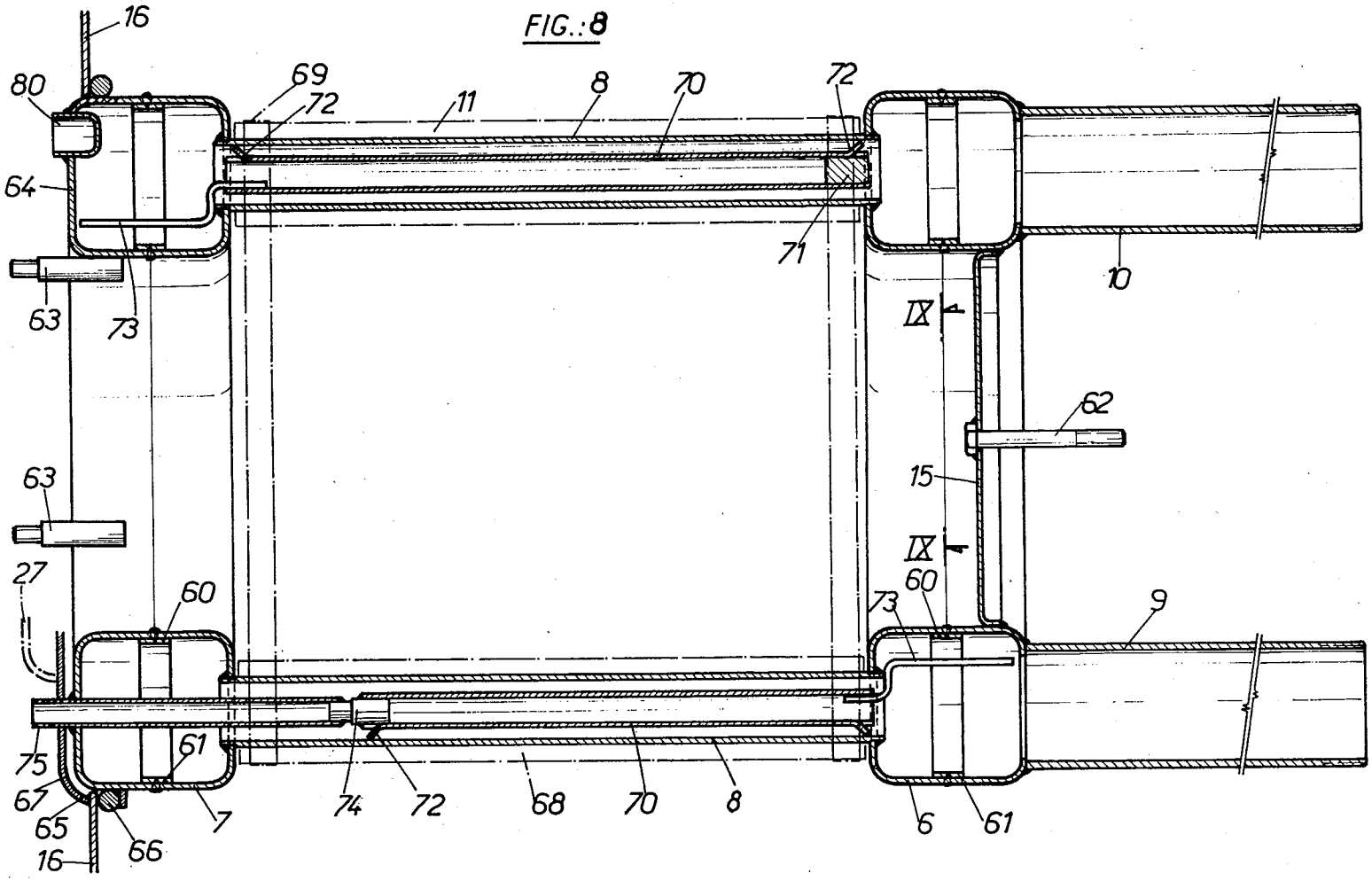
FIG. 8 is a diagrammatical view in longitudinal section of the exchanger of the boiler.
Figure 10:
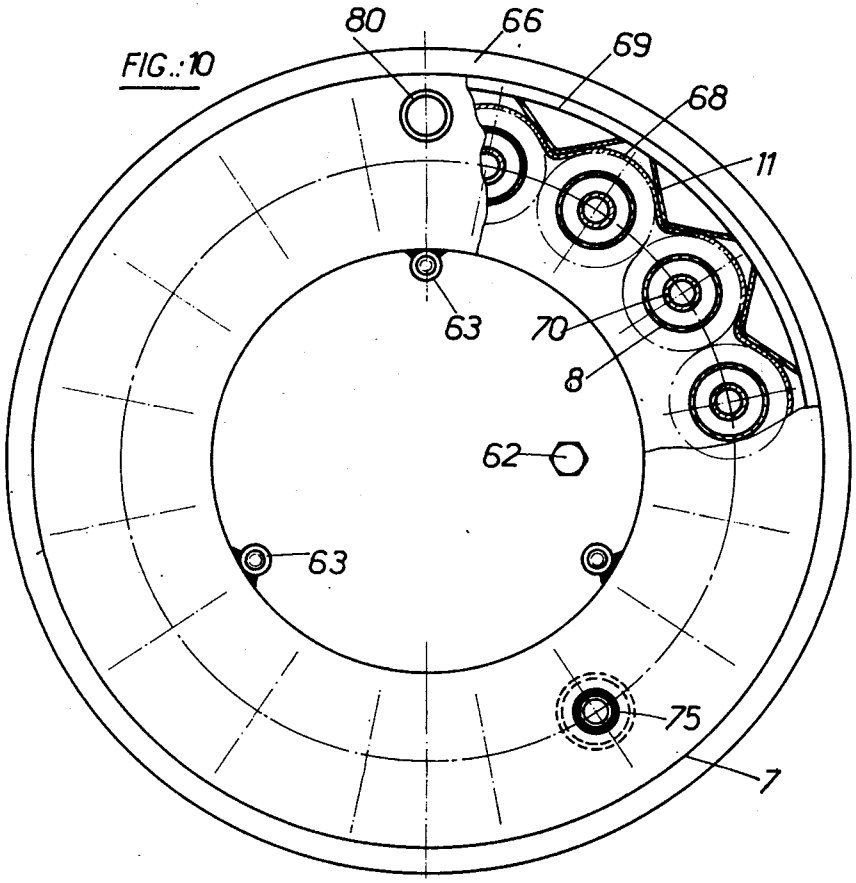
FIG. 10 is an end view taken from the left, partly broken away.

FIGS. 8 and 10 show details of the exchanger.

The annular headers 6 and 7 connecting the tubes 8 can be seen therein. The headers are composed of half-shells welded to one another in an equatorial plane with the aid of cover strips 60 and 61.

The partition 15 closing the header 6 carries the bolt 62 enabling it to be fastened to the casing. While the header 7 has pins 63 intended to be engaged in the holes 28 in the ring 27 of the burner in order to join the latter to the exchanger.

The header 7, whose outer half-shell 64 projects slightly through an opening 65 in the cover 16 of the casing, is provided with a seal packing 66 opposite which is applied a cover strip 67 against which the ring 27 of the burner bears (FIG. 8).

The assembly formed by the burner and the exchanger is very compact. The perforated tube 17 of the burner extends between the headers 6 and 7 practically over the entire length of the tubes 8, as can be clearly seen in FIG. 3, the distance between the tube 17 and the tubes 8 being relatively short, for example of the order of one times the diameter of the tube, that is to say usually a few centimeters. This, combined with the presence of the fins and baffles 11, which can be formed by simple V-shaped sections having wide openings and bearing longitudinally against the fins 68 between the headers and may be held in place by collars 69 as shown in FIG. 10, ensures vigorous exchange of heat which makes it necessary for the circulation of water inside the tubes 8 to be accelerated in order to avoid local vaporisation phenomena.

To this end, it can be seen in FIGS. 7 to 10, each of the tubes 8 contains a core 70 consisting of a tube whose section is of the order of half the passage section of the tube 8. This core is closed, for example, by a plug 71. It is a litter shorter than the tube 8, in which it is centred with the aid of folded-over lugs 72, of which there are for example six, distributed at intervals of 120° on the periphery of the tube 70, at the ends of the latter. A cranked extension 73 engaged in the header 6 or 7 prevents the core from being released longitudinally.

One of the cores 70, which is shorter than the others, may be used for mounting a thermostatic cam 74 passing in a sheath 75 extending through the half-shell 64 and welded to the latter (FIG. 8, bottom, and FIG. 10).

Figure 9:
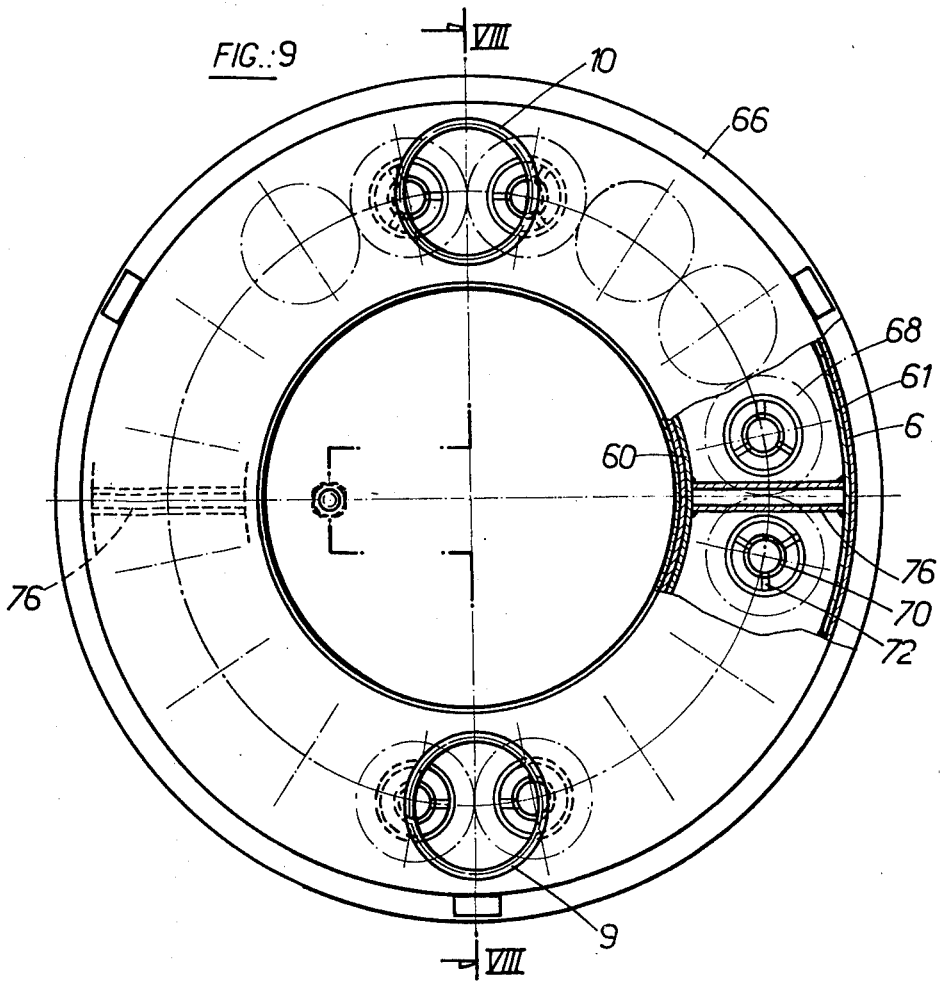
FIG. 9 is an end view taken from the right, with partical section on the line IX—IX in FIG. 8.

In FIG. 9 can be seen the baffles 76 of the header 6, which oblige the water to circulate correctly in the exchanger.

Figure 11:
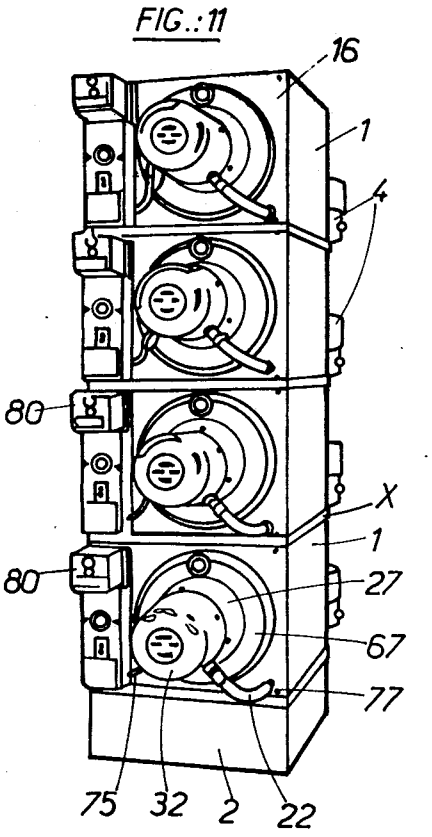
FIG. 11 shows diagrammatically a battery of four superimposed boilers.

FIG. 11 shows how a battery of boilers can be arranged in such a manner as to occupy only a minimum volume.

The modular boilers are simply placed one above the other. A T-shaped frame (X) prevents the boilers from slipping.

The water and gas pipes are connected at the rear face, where the flue gas outlet is also disposed.

This generally parallelepipedic structure makes it possible to obtain a compact battery of high power.

Thus, four boilers of 150 therms per hour occupy on the ground an area of 500 × 640 millimeters and a height of 1800 millimeters, including the base.

They weigh 640 kilograms, whereas a conventional boiler of the same power occupies several cubic meters and weighs nearly three tonnes.

It is obvious that the embodiments are only examples and that they could be modified, particularly by substituting technical equivalents, without thereby departing from the scope of the invention.

I claim:

1. A gas-burning boiler comprising
a boiler chamber,
walls defining said boiler chamber,
a plurality of heat-exchanger tubes arranged in said chamber, the heat exchanger tubes being parallel to each other,
an outlet for gases from the chamber in one of said walls,
an extraction fan in said outlet,
a burner unit mounted in said chamber and penetrating an aperture in one of said walls,
the burner unit comprising an inlet for combustion air gas fuel into the chamber,
ignition means in said chamber for igniting the combustion air and gas fuel,
a flame surface of said burner unit extending between the heat exchange tubes of the plurality of heat exchange tubes and generally parallel to them and baffle means in said chamber for defining a gas flow path from the burner unit to the fan such that hot gases flow from said flame surface substantially equally over each of the plurality of heat exchanger tubes, whereby upon operation of the extraction fan combustion air and gas fuel are drawn into the chamber and ignited there under a sub-atmospheric pressure.

2. A gas-burning boiler as claimed in claim 1, wherein two of the said walls are parallel and spaced apart, one of said two walls having the outlet centrally disposed in it and the other of said two walls having the aperture centrally disposed in it, the aperture and outlet being generally horizontally level with each other, and the flame surface and the heat exchange tubes extending generally horizontally.

3. A gas-burning boiler as claimed in claim 1, wherein the heat-exchange tubes have two horizontal ends within the chamber, respective headers at the horizontal ends of the tubes and defining a flow path for a heat exchange medium through the tubes, each header being generally annular and one being adjacent the wall having the aperture, one being adjacent the wall having the outlet, the said walls being spaced apart and parallel, the burner unit passing radially inside the radially inner circumference of one said header and terminating immediately adjacent the other said header, and baffle means preventing flow of gas radially inside the radially inner circumference of the other said header.

4. A gas-burning boiler as claimed in claim 3 having additional baffle means disposed in the chamber radially externally of the heat exchange tubes for directing flow of gas arcuately over at least a portion of the circumferential surface of the tubes.

5. A gas-burning boiler as claimed in claim 4, wherein the heat exchange tubes are finned and are in a regular, close packed annular array round the flame surface, the additional baffle means comprising cuspoidal V-section plates of which the cusps are disposed radially between fins of adjacent heat-exchange tubes of the array.

6. A gas-burning boiler as claimed in claim 1, wherein the sub-atmospheric pressure is at least 12 mm water column below atmospheric.

7. A gas-burning boiler as claimed in claim 1, wherein the sub-atmospheric pressure is between about 50 and 15 mm water column below atmospheric.

8. A gas-burning boiler as claimed in claim 1, wherein a self-regulating reduced pressure regulator is associated with the chamber.

9. A gas-burning boiler as claimed in claim 4, wherein the reduced pressure regulator comprises a volume communicating with the chamber, the volume having a base, and an air inlet aperture combined with a weighted plate serving as valve.

10. A gas-burning boiler as claimed in claim 3, wherein the radial distance between the flame surface of the burner and the exchanger tubes is of the order of the diameter of the tubes.

11. A gas-burning boiler as claimed in claim 10, wherein the flame surface of the burner is lined internally by a grid permitting the clinging of the flame.

12. A gas-burning boiler as claimed in claim 11, wherein the grid is covered by a perforated wall connected at its ends to unperforated portions of the burner and intended to produce a loss of head ensuring uniformity of distribution of the mixture of air and gas inspired through the outlet holes of the burner.

13. A gas-burning boiler as claimed in claim 12 including a central baffle consisting of a cylindrical or conical body fixed to the inner end of the burner.

14. A gas-burning boiler as claimed in claim 1, wherein a portion of the burner outside the chamber wall is open and comprises a cup-shaped annular gas distributor which caps the said portion with clearance and on its inner side surface has gas outlet apertures.

15. A gas-burning boiler according to claim 1, wherein a portion of the burner outside the chamber wall contains a profiled hollow core which is rounded in the downstream direction and is pierced with outlet apertures in the upstream direction and is connected to a gas supply pipe, this burner being in addition equipped with an air admission regulating device.

16. A gas-burning boiler as claimed in claim 1, wherein at least some of the heat exchanger tubes have throttle means in them.

17. A gas-burning boiler as claimed in claim 16, wherein the throttle means comprises a core tube centrally disposed in a said heat exchanger tube.

18. A gas-burning boiler as claimed in claim 17, including blocking means in the said core tube intermediate its ends, one end of the core tube extending to outside the chamber.

19. A gas-burning boiler according to claim 1, wherein the chamber has an external shape of a right parallelepiped whereby a plurality of said chambers may be stacked directly adjacent each other.

* * * * *